US007121888B2

(12) United States Patent
Brandt et al.

(10) Patent No.: US 7,121,888 B2
(45) Date of Patent: Oct. 17, 2006

(54) MULTIPLE WIRE CABLE CONNECTOR

(75) Inventors: Konrad W. Brandt, Dusseldorf (DE); Guenter Ploehn, Up de Kopeel (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/519,652

(22) PCT Filed: May 22, 2003

(86) PCT No.: PCT/US03/16296

§ 371 (c)(1),
(2), (4) Date: Aug. 22, 2005

(87) PCT Pub. No.: WO2004/008580

PCT Pub. Date: Jan. 22, 2004

(65) Prior Publication Data

US 2006/0014416 A1 Jan. 19, 2006

(30) Foreign Application Priority Data

Jul. 10, 2002 (EP) ..... 02015328

(51) Int. Cl.
*H01R 13/648* (2006.01)

(52) U.S. Cl. ..... 439/608; 439/610; 439/731; 439/579; 439/248; 439/701

(58) Field of Classification Search ..... 439/731, 439/607, 247, 610, 679, 701, 352, 902, 608
See application file for complete search history.

(56) References Cited

U.S. PATENT DOCUMENTS

| | | | | |
|---|---|---|---|---|
| 4,954,094 | A * | 9/1990 | Humphrey | 439/247 |
| 4,981,447 | A * | 1/1991 | Ichitsubo | 439/607 |
| 5,011,424 | A * | 4/1991 | Simmons | 439/352 |
| 5,074,524 | A * | 12/1991 | Wade | 251/149.6 |
| 5,108,313 | A * | 4/1992 | Adams | 439/610 |
| 5,184,965 | A | 2/1993 | Myschik et al. | |
| 5,676,569 | A * | 10/1997 | Davis | 439/731 |
| 5,788,528 | A * | 8/1998 | Orr et al. | 439/358 |
| 5,831,815 | A * | 11/1998 | Miller et al. | 361/679 |
| 5,895,292 | A | 4/1999 | Affreltranger | |
| 6,203,369 | B1 | 3/2001 | Feldman | |
| 6,238,246 | B1 * | 5/2001 | Ferrill et al. | 439/610 |
| 6,305,961 | B1 | 10/2001 | Szilagyi et al. | |
| 6,575,794 | B1 * | 6/2003 | Nakamura | 439/701 |
| 2002/0025722 | A1 * | 2/2002 | Inagawa et al. | 439/610 |
| 2003/0104728 | A1 * | 6/2003 | Inagawa et al. | 439/610 |
| 2004/0048516 | A1 * | 3/2004 | Mandrusov et al. | 439/610 |

FOREIGN PATENT DOCUMENTS

| | | |
|---|---|---|
| DE | 27 36 079 | 2/1979 |
| EP | 0 074 205 | 3/1983 |
| EP | 0 477 793 A2 | 4/1992 |
| EP | 0 831 559 A2 | 3/1998 |
| EP | 0 952 637 A1 | 10/1999 |
| WO | WO 94/11926 | 5/1994 |
| WO | WO 99/63628 | 12/1999 |

* cited by examiner

*Primary Examiner*—Neil Abrams
*Assistant Examiner*—Harshad C Patel
(74) *Attorney, Agent, or Firm*—Melanie G. Gover

(57) ABSTRACT

The multiple wire cable connector comprises an outer housing having at least one opening for a multiple wire cable to pass therethrough and at least one inner housing for arranging therein termination sockets of the wires of the multiple wire cable the inner housing comprising a front end for contacting a device to be electrically connected to the wires of the multiple wire cable, and a receiving end for receiving the wires of the multiple wire cable.

19 Claims, 9 Drawing Sheets

MULTIPLE WIRE CABLE CONNECTOR

FIELD OF THE INVENTION

The present invention relates to a multiple wire cable connector allowing high speed and large band width signal transmission and EMI shielding.

BACKGROUND

Some connectors for connecting multiple wire cable (e.g. multiple coaxial cables or multiple twisted pair cables) are known in the prior art. These connectors are used, for example, in telecommunication applications to connect a multiple wire cable to an electronic card, for example at the face plate of a 19" rack card. Such a connector is described for example in EP-A-0 952 637.

The connector of EP-A-0 952 637 comprises two metal casing components for housing a socket connector that is adapted to receive a plurality of coaxial or twisted pair cables each terminated in a termination socket. The metal casing provides an electromagnetic shield but it leaks somewhat through the opening in the casing through which the multiple wire cable passes.

There is a need in the telecommunication field to increase the signal density and the signal transmission rate. This need can be achieved by increasing the number of wires or cables or by increasing the frequency by which the signals are transmitted. The first approach results in the connector becoming rather large while the second approach results in problems of shielding electromagnetic radiation.

Electromagnetic radiation can exit, for example, from the face plates of electronic cards to which the connector may be connected. This electromagnetic radiation can penetrate into the connector through its front end. The outer shell of the connector has a passage or throughhole through which the multiple wire cable passes into the connector. The more wires contained in the cable, the larger the cable size and, accordingly, the larger the passage or throughhole must be. However, large throughholes mean that the lower limit of the frequency at which electromagnetic radiation leaks through the throughhole decreases.

Accordingly, there is a need for better electromagnetic shielding of connections between multiple wire cable connectors (especially having a large number of individual wires) and electronic devices, with electronic cards, to permit high speed and large band width signal transmission as well as high signal density transmission through the connection.

EP-A-0,074,205 and EP-A-0,670,082 describe coaxial high-frequency, plug-type connectors for multiple coaxial lines that have individual termination sockets for the individual coaxial cables inserted into associated receiving pockets and that open at their rear ends. They do not have any outer shell arranged around the row of termination sockets.

SUMMARY

The invention provides a multiple wire cable connector comprising:

an outer housing having at least one opening for a multiple wire cable to extend therethrough, at least one inner housing for arranging therein termination sockets for connecting two wires of a multiple wire cable, the inner housing comprising (i) a front end for contacting a device to be electrically connected and (ii) a receiving end for receiving the wires of the multiple wire cable, wherein the inner housing comprises a circumferential wall extending between the front and receiving ends of the at least one inner housing, and a cover for covering the receiving end of the inner housing, wherein the cover and the wall of the inner housing are comprised of electrically conductive material, and the outer housing comprises at least one receiving opening in which the inner housing or inner housings are arranged.

According to the invention, at least one inner housing is arranged within an outer housing (or shell) having an opening through which a multiple wire cable can pass. The inner housing(s) receives, or is provided with, termination sockets for the individual wires of the multiple wire cable. The individual wires could, for example, be in the form of individual coaxial cables or twisted pair wires.

The inner housing comprises a front end and a receiving end for receiving the wires of the multiple wire cable. Accordingly, the wires extend through the receiving end of the inner housing and terminate at termination sockets arranged in the inner housing. Access to the termination sockets of the inner housing is provided through the front end of the inner housing. The front end of the inner housing contacts the front plate of an electronic device, e.g. an electronic card, to which the multiple wire cable connector can be connected. Accordingly, the front end of the inner housing is oriented face-to-face with the face plate of the electronic device.

The receiving ends of the inner housing receiving the termination sockets of the individual wires, according to a preferred embodiment of the invention, are each provided with a cover. This cover together with the walls of the inner housing can comprise an electromagnetic shield when they are made from an electrically conductive material. Accordingly, electromagnetic radiation entering into the inner housing through its front end is prevented from leaving thereof by the cover. Therefore, electromagnetic shielding provided by the Faraday-cage-like structure of the inner housing walls is enforced by the use of the covers.

In order to prevent electromagnetic radiation from escaping at the interface between the connector and the face plate of an electronic device (e.g., electronic card), the front end of the inner housing(s) should be positioned very close to the face plate along the entire length of the front end(s). Gaps between the face plate and the front end(s) of the inner housing(s) should be avoided or minimized. This is often difficult to achieve, especially when the connector and face plate are rather long (because many wires are being connected by the connector to the electronic device).

The invention permits one to reduce or minimize gaps because the inner housings are capable of moving within the receiving opening of the outer housing. In particular, the inner housing(s) is biased in a direction outward from the receiving opening of the outer housing. This allows the inner housing(s) to mechanically adapt to the shape of the face plate of the electronic device, even if it is slightly curved. By simply pressing the connector of the invention against a face plate of an electronic device, the opposite sides of the inner housing(s) will move in a more or less vertical direction in response to forces from the face plate. This movement adapts the inner housing orientation to the shape of the face plate thereby reducing the size of the gap between the connector and the face plate.

The resilient means for biasing the inner housings in a direction out of the receiving opening of the outer housing most preferably is a helical spring element, a beam-like spring element or an element comprising compressible material. However, every other element allowing resiliency can be used. The resilient means acts both on the outer housing or an element operatively connected to the outer housing, and on the inner housings or an element or elements operatively connected to the inner housings. Moreover, for each inner housing at least one resilient element is necessary. However, it is preferred to have at least two resilient elements for each inner housing. In general, the resilient means acts on each inner housing so that it does not prevent movement within the receiving opening.

As explained above, the movable or floatable and, in particular, tiltable arrangement of each inner housing within the receiving openings of the outer housing more closely bring together the front end of the inner housing and the face plate of the electronic device, thereby minimizing the gap between the front end of the inner housing and the face plate.

Alternatively or additionally, according to another aspect of the invention electromagnetic shielding gasket can be arranged between the front end of an inner housing and the front plate of the electronic device to be contacted. Electronic shielding gaskets known in the prior art for electromagnetically shielding doors, flaps or the like of housings of electronic devices are suitable. One example of a useful gasket is described in U.S. Pat. No. 6,305,961. The electromagnetic shielding gaskets are resilient, elastic and comprise electrically conductive material. They, for example, may have various designs, for example, they can have the shape of a corrugated annular element like an electromagnetic sealing ring or have individual bent fingers extending from a web or like element. Any known electromagnetic shielding gasket can be used for the invention.

In a further embodiment of the invention the outer housing also comprises an electrically conductive material for providing electromagnetic shielding. In this embodiment, there is double electromagnetic shielding because the housings and the outer housing each provide electromagnetic shielding. Using an electrically conductive material for the manufacture of the outer housing is also advantageous if a twisted pair cable version or other multiple wire cable arrangement is used that has an outer cable shield. In this case, the outer cable shield can be connected to the outer housing.

As mentioned in the preferred embodiment referred to above, covers close the receiving ends of the inner housings and individual wires pass through the covers. Preferably the covers are in direct contact with the circumferential walls of the inner housings so that there is no gap between the wall and the cover, respectively. It is possible to use an electromagnetic shielding gasket between the covers and the walls of the inner housing for further shielding. The cover could be a part separated from the inner housings and the outer housing, wherein to each inner housing, an individual cover is associated or alternatively, one common cover may be provided for several inner housings. The covers can be mounted to the inner housings by suitable fastening means like screws, bolts, adhesives or the like. As an alternative, the cover can also be arranged at the outer housing so as to cover the receiving end of the inner housings when the connector is assembled. Also in this embodiment, one cover may be used for each inner housing or several inner housings may be covered by one common cover. In the latter cases, the outer housing can be made from an electrically non-conductive material. Also the outer housing and the cover both can comprise electrically conductive material.

The passageways through which the wires pass into the inner housings at is receiving ends should be as small as possible in order to prevent electromagnetic leakage at the covered receiving end of the at least two inner housings. The cover preferably is provided with several small openings through which the individual wires or groups of wires, for example two wires, pass. According to this embodiment, the cover preferably comprises at least two engaging cover sections each having an edge with recesses. The recesses of these two cover section together form the wire openings of the cover when the two cover sections are assembled. The split cover is easy to arrange and mount after the individual wires and their termination sockets are inserted in the inner housings.

In some electronic and, in particular telecommunication applications it is desirable for redundancy purposes, to have the wires of one multiple wire cable connector simultaneously connected to two electronic devices electrically arranged in parallel. Should one of these electronic devices fail, the other electronic device still works and provides for the required electrical function of the overall system.

In order to meet this requirement, in one embodiment of the invention, each inner housing comprise contact elements to which the termination sockets of the wires are connected. These contact elements via conducting lines are also electrically. connected to at least one additional connector element arranged outside of the outer housing. The at least one additional connector element can be provided in any suitable design with good electromagnetic shielding and preferably comprises electrically conductive material and has small, narrow through passages through which the conducting lines pass from outside the connector into the at least one additional connector element.

The conducting lines preferably are in the form of a flexible circuit or a ribbon cable. The flexible circuit can be provided with PCB sections connected to the contact elements of the at least one inner housing and contact elements of the at least one additional connector with a flexible circuit arranged in between these two PCB sections. An opening (e.g. a slit) can be provided in each inner housing and each additional connector element through which the conducting lines (flexible circuit or ribbon cable) can pass. Preferably each inner housing and, accordingly, the outer housing and each additional connector element are provided with several slit-like openings or openings of another shape through which groups of conducting lines can pass. These openings are preferably each provided with electromagnetic shielding gaskets to prevent emission of electromagnetic radiation through the openings.

BRIEF DESCRIPTION OF THE DRAWING

In the following preferred embodiments of the invention will be described referring to the drawing in which.

DETAILED DESCRIPTION

Figure 1:
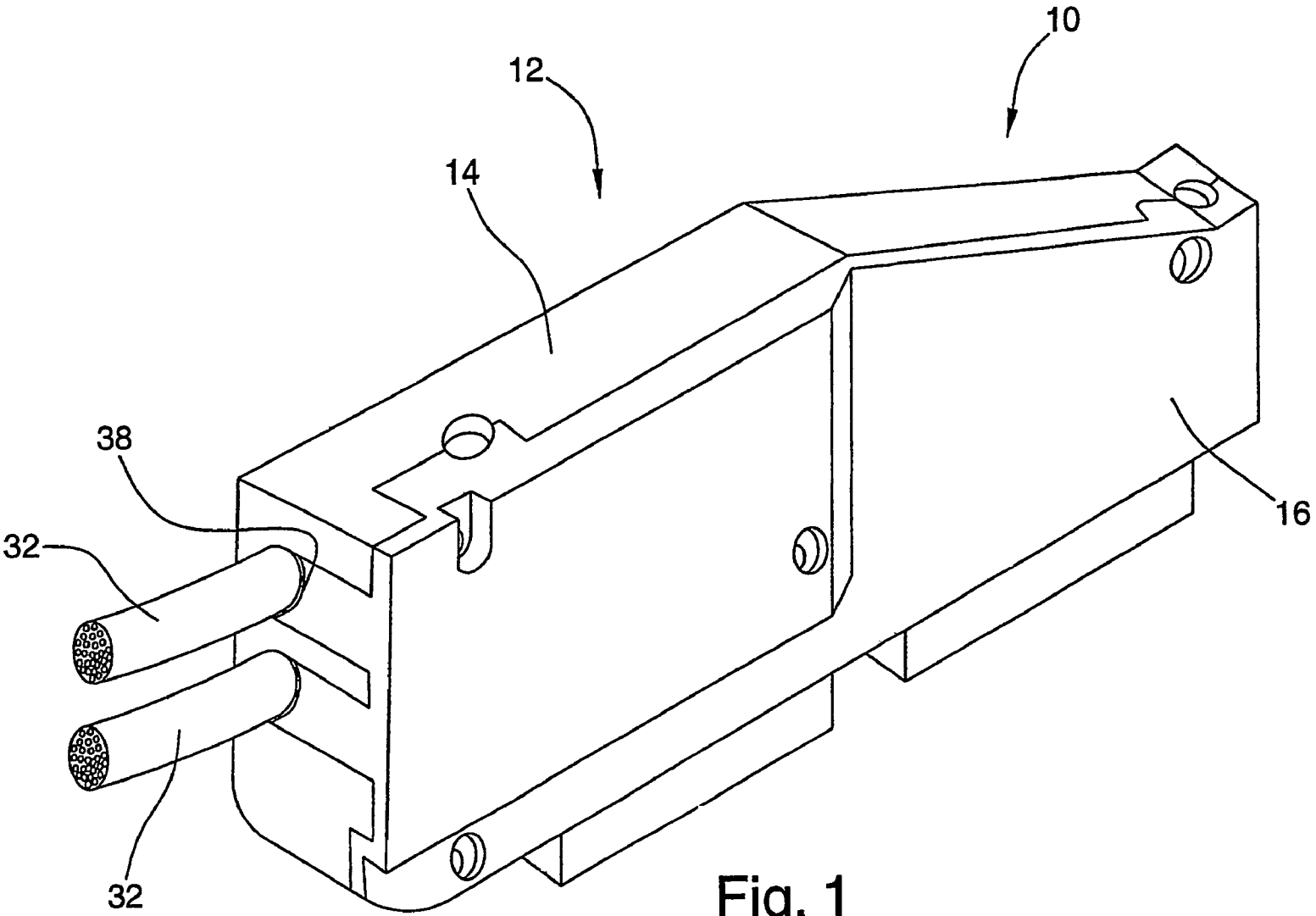
FIG. 1 is an isometric view of a first embodiment of a multiple wire cable connector.
Figure 2:
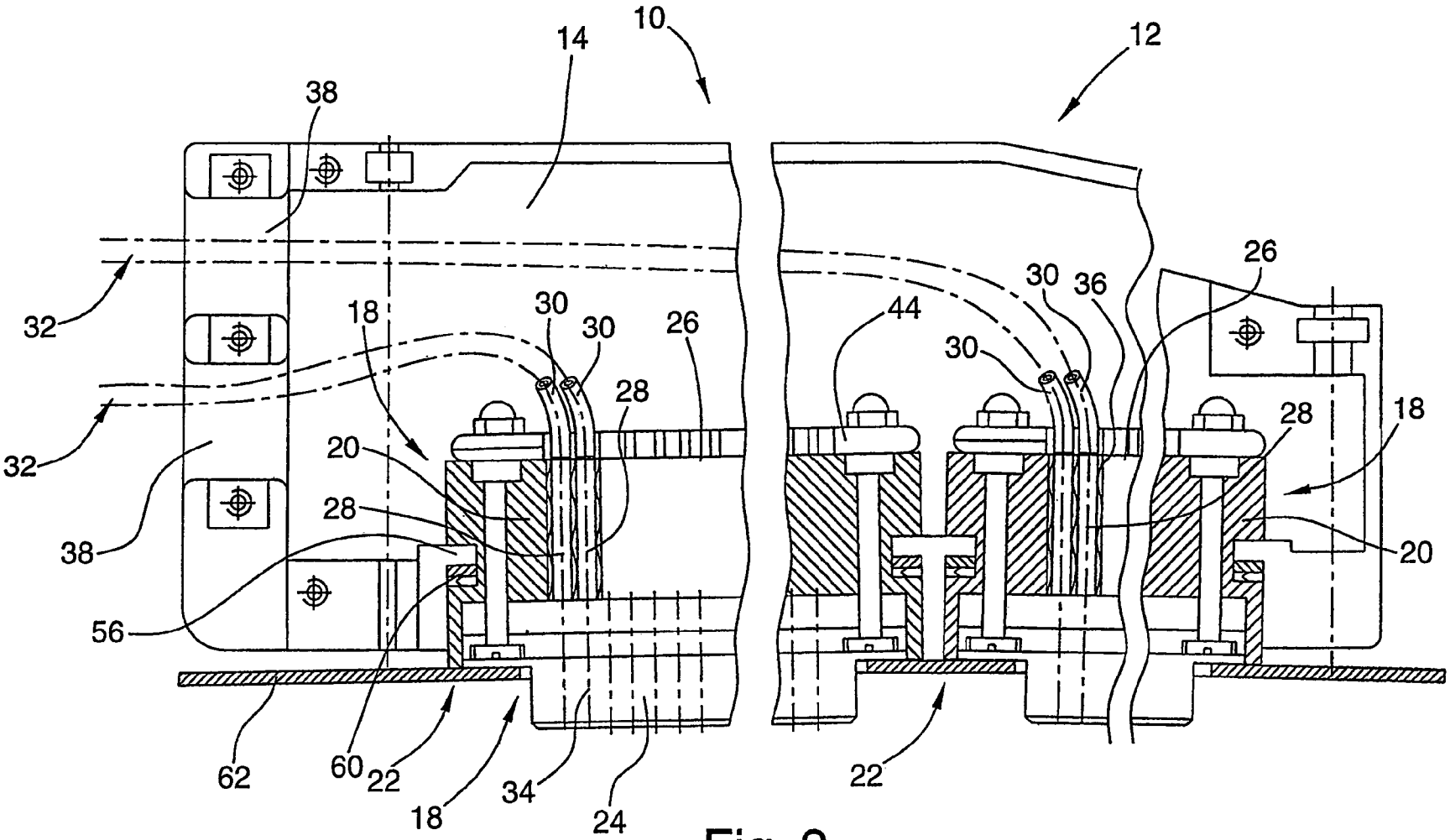
FIG. 2 is a cross-sectional view of the connector according to FIG. 1.
Figure 3:
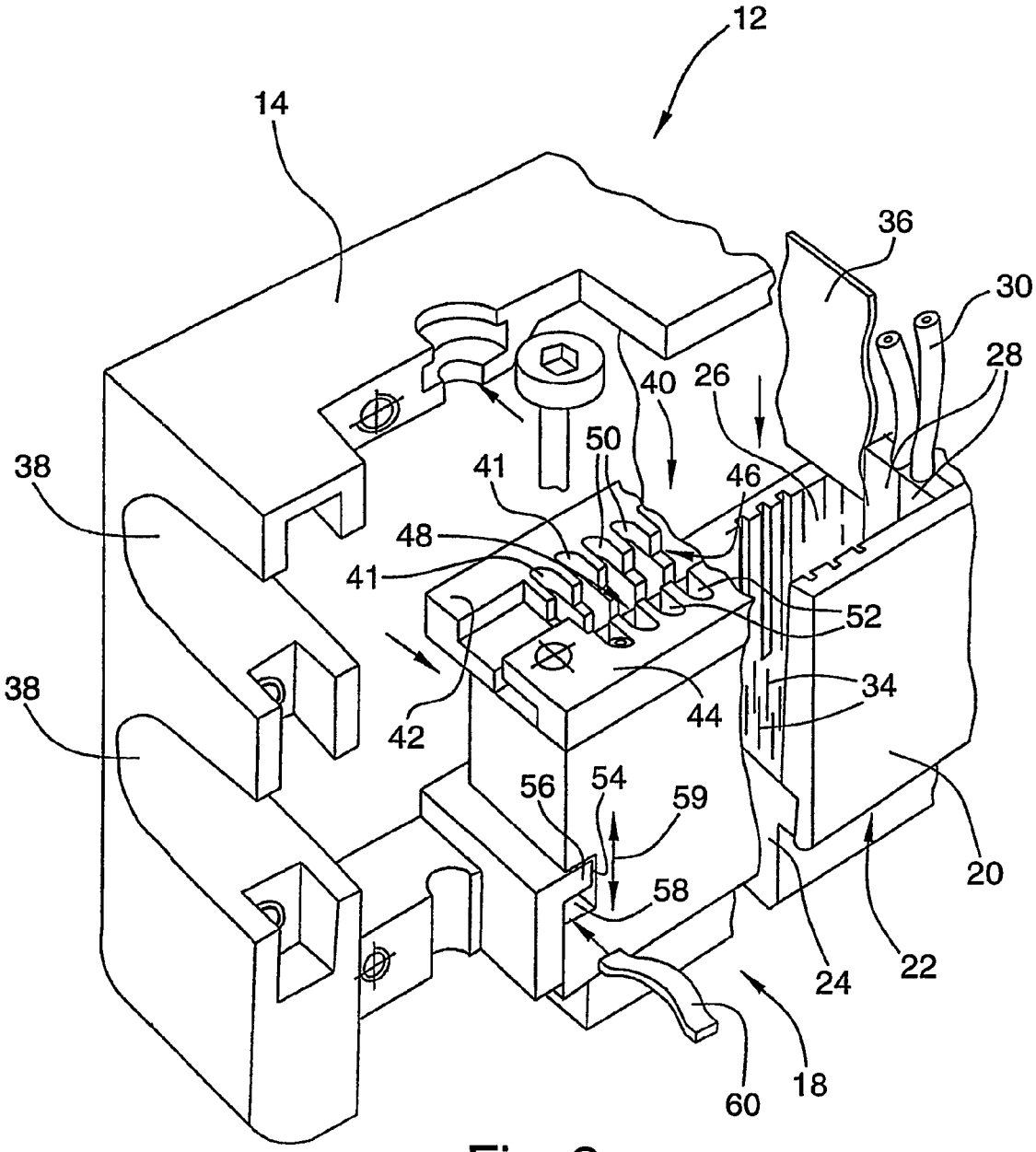
FIG. 3 is an isometric and exploded representation showing the internal construction of the connector according to FIGS. 1 and 2, FIGS. 4 and 5 showing the concept of increasing interface slits by using several floatable small inner housings instead of one single large inner housing.

In FIGS. 1 to 3 a first embodiment of a multiple wire cable connector is shown. This connector 10 comprises an outer housing 12 having two casing components 14,16. The casing components can be made of metal. However, other materials and, in particular, electrically non-conductive materials such as plastic materials can be used. The material used for the casing components 14,16 can also be a composite material made from metal and plastic material, e.g. metallized plastics or metal-plated plastics, metal-coated plastics or plastic material comprising metal particles.

As can be seen in FIG. 2, within the outer housing 12 there are arranged two inner housings 18. Each inner housing comprises a circumferential wall 20 (see also FIG. 3) at a front end 22 thereof a 4-row board mount socket 24 is arranged and projects from the front end 22. Opposite to the front end 22 of each inner housing, the circumferential wall 20 thereof defines an opening providing access to the interior of the inner housing 18. These openings define receiving ends 26 of the inner housings 18 through which individual wires or cables pass into the inner housings 18.

Within the interior of each inner housing 18 there is arranged a plurality of termination sockets 28 connected to individual coaxial cables 30 of the multiple wire cable 32. Most preferably the termination sockets for coaxial cables are designed as SCI sockets like those disclosed, for example, in U.S. Pat. No. 5,184,965, U.S. Pat. No. 6,203,369 and EP-A-0,477,793. As an alternative, for wires presented in a twisted pairs CHG sockets can be used for the termination sockets. The type of termination socket provided in the inner housing may vary according to the preferences of the uses, however any known design of termination sockets for wires can be used in the invention.

The SCI termination sockets 28 are arranged in two rows with the contact elements of the SCI termination sockets 28 (not shown) being in contact with contact pins 34 of the board mount socket 24. Between each pair of adjacent SCI termination sockets 28, there are arranged corrugated bussing plates 36 that contact the electrically conductive housings of the SCI termination sockets 28. The corrugated bussing plates 36 are electrically conductive so that ground bussing is provided within and throughout each of the inner housings 18.

The arrangement of the SCI termination sockets 28 and the corrugated ground-bussing plates 36 are disclosed in more detail in co-pending European patent application "Socket connector for receiving a plurality of termination sockets for coaxial cables" of the applicants which is filed on the same day as the instant application and which is incorporated herein by reference.

As can be seen from FIGS. 1 and 2, the coaxial cables 30 leading to each of the inner housings 18 are assembled into a respective multiple wire cable 32. Each multiple wire cable 32 passes through an opening 38 in the outer housing 12. A common opening 38 for both cables 32 can be provided alternatively.

The number of individual inner housings used in the invention will vary, to an extent, with the number of individual wires in the multiple wire cable. The inner housings are located in respective receiving opening(s) of the outer housing. For example to connect a 128 mini coaxial cable or twisted pair cables a multiple wire cable connector is used having two inner housings each designed to accommodate 64 cables.

The connection for the individual wires in the termination sockets can be arranged in each inner housing in one or several rows.

Referring to FIG. 3, the openings at the receiving end 26 of each of the inner housings 18 is covered by a cover 40. Each cover 40 is provided with several longitudinal openings 41 through which the individual coaxial cables 30 pass. The cover 40 comprises two separate cover sections 42,44 having confronting edges 46,48 provided with recesses 50,52. When assembled the recesses 50,52 form the individual longitudinal openings 42 of the cover 40.

As will be clear to those skilled in the art, it is also possible to use a cover comprising a single cover plate with holes therein. The holes or openings need not to be longitudinal but also could be circular or of any other shape. Also it is possible that for each coaxial cable 30 a separate bore, hole or opening or the like can be provided in the cover plate.

As can be seen from FIG. 3, the individual coaxial cables 30 pass pair-wise through the longitudinal openings 41 of the cover 40. The cover 40 as well as the wall 20 of the inner housings 18 preferably are made from metal. However, other electrically conductive materials and composite materials comprising non-conductive and conductive materials may be used having electromagnetic shielding properties. Materials with at least some conductive properties are preferred because electrically then the inner housings 18 provide electromagnetic shielding and the outer housing 12 needs not be designed to provide EMI shielding.

Referring back to FIG. 3, the circumferential walls 20 of the inner housings 18 are arranged within receiving openings 54 of the outer housing 12. Each receiving opening 54 is provided at two opposite edges with inwardly projecting flanges 56 extending into receiving channels 58 provided in the wall 20 at two opposite lateral sides thereof. The receiving channels 58 are wider than the thickness of the flanges 56 so that each of the inner housings 18 can move within the receiving opening 54 in the direction indicated at 59 in FIG. 3. Also inserted in the receiving channels 58 are beam-like spring elements 60. The spring elements 60 bias the inner housings 18 in a direction out of the receiving openings 54 of the outer housing 12.

It should be clear for those skilled in the art that other biasing mechanisms for the inner housings 18 can be used. For example, helically wound springs can be used between the inner housings 18 and the outer housing 12 in order to bias the inner housing 18 in a direction out of the receiving openings 54.

Due to the movable arrangement of the inner housings 18 within the outer housing 12, the inner housings 18 can move and tilt an adapt to the shape of a front plate 62 of an electronic device. As can be seen from FIGS. 2, 4, and 5, if the front plate 62 is non-planar or uneven (e.g., slightly curved) and if the connector 10 would be provided with one single inner housing 18 the front end 22 thereof could not accurately physically contact the front plate 62 so that electromagnetic radiation can escape out of the interface between the front end 22 of the inner housing 18 and the front plate 62. In the embodiment of the present invention as shown in FIGS. 1 to 3 the individual inner housings 18 due to their floating arrangement can adapt more precisely to the shape of the front plate 62 resulting in a reduction of the length and height of a slit-like gap between the front ends 22 of the individual housings 18 and the front plate 62. This feature in particular is important for connectors 10 which are rather long for accommodating a lot of terminal sockets 28.

Figure 4:
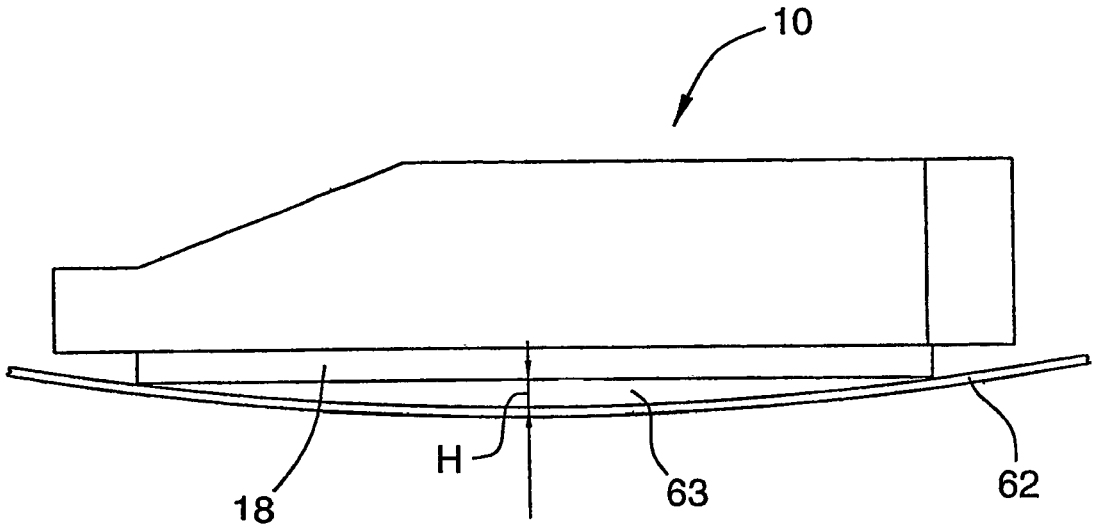
Figure 5:
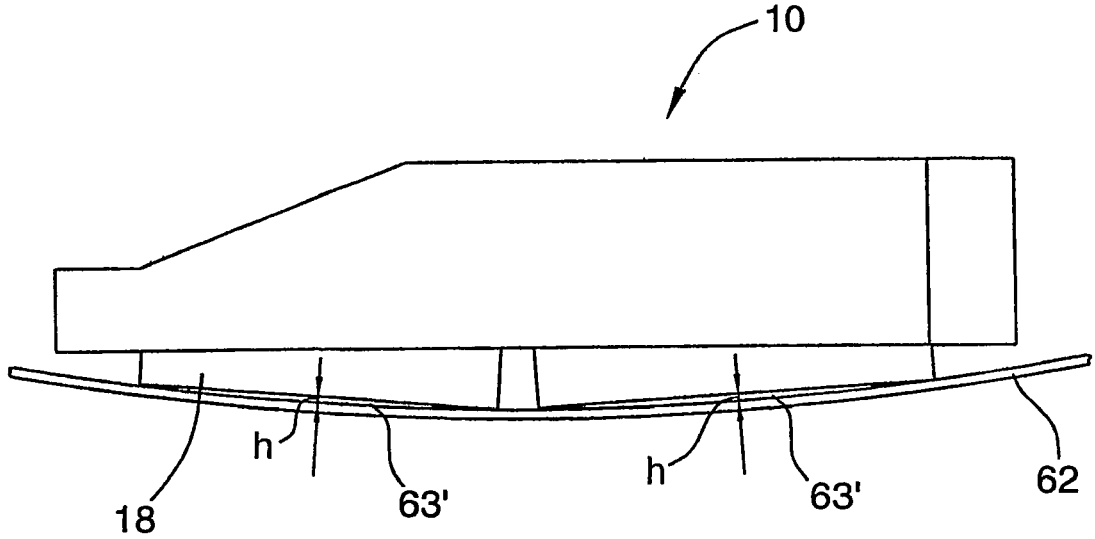

The concept of reducing the size of a potential gap on the one hand between a known connector having one single inner housing and a front plate of an electronic device and on the other hand between a connector according to the invention and having two (or more) inner housings movably arranged and a front plate of an electronic device is shown in FIGS. 4 and 5. In FIG. 4, due to a concave curvature of front plate 62 causes a rather wide gap 63 with a maximum height, "H", (lateral extension). This gap 63 cannot be sealed with a electromagnetic shielding gasket (not shown) because such a gasket could not completely fill the gap along its length and, in particular, the area around the maximum height, "H".

If, as shown in FIG. 5, two (or more) movably arranged inner housings 18 are provided, these inner housings 18 adapt to the curvature of the front plate 62 by automatically adjusting their relative positions thereto within the outer housing 12. This self-adjustment results in the generation of two (or more) smaller and narrower gaps 63' each having a maximum height, "h", that is smaller than the maximum height, "H", of FIG. 4. The maximum height, "h", is so small that the gaps 63' can be sealed by conventional electromagnetic shielding gaskets (not shown) resulting in improved EMI shielding of the connector of FIG. 5 (and FIGS. 1 to 3) relative to that of FIG. 4.

The above-described embodiment of the connector uses SCI terminal sockets and coaxial cables. However, it is also possible to use other kinds of wires or cables and sockets, for example twisted pair cables are used and their termination sockets can be used. Also the number of rows along which the termination sockets are arranged in each of the inner housings can vary relevant for the invention.

Figure 6:
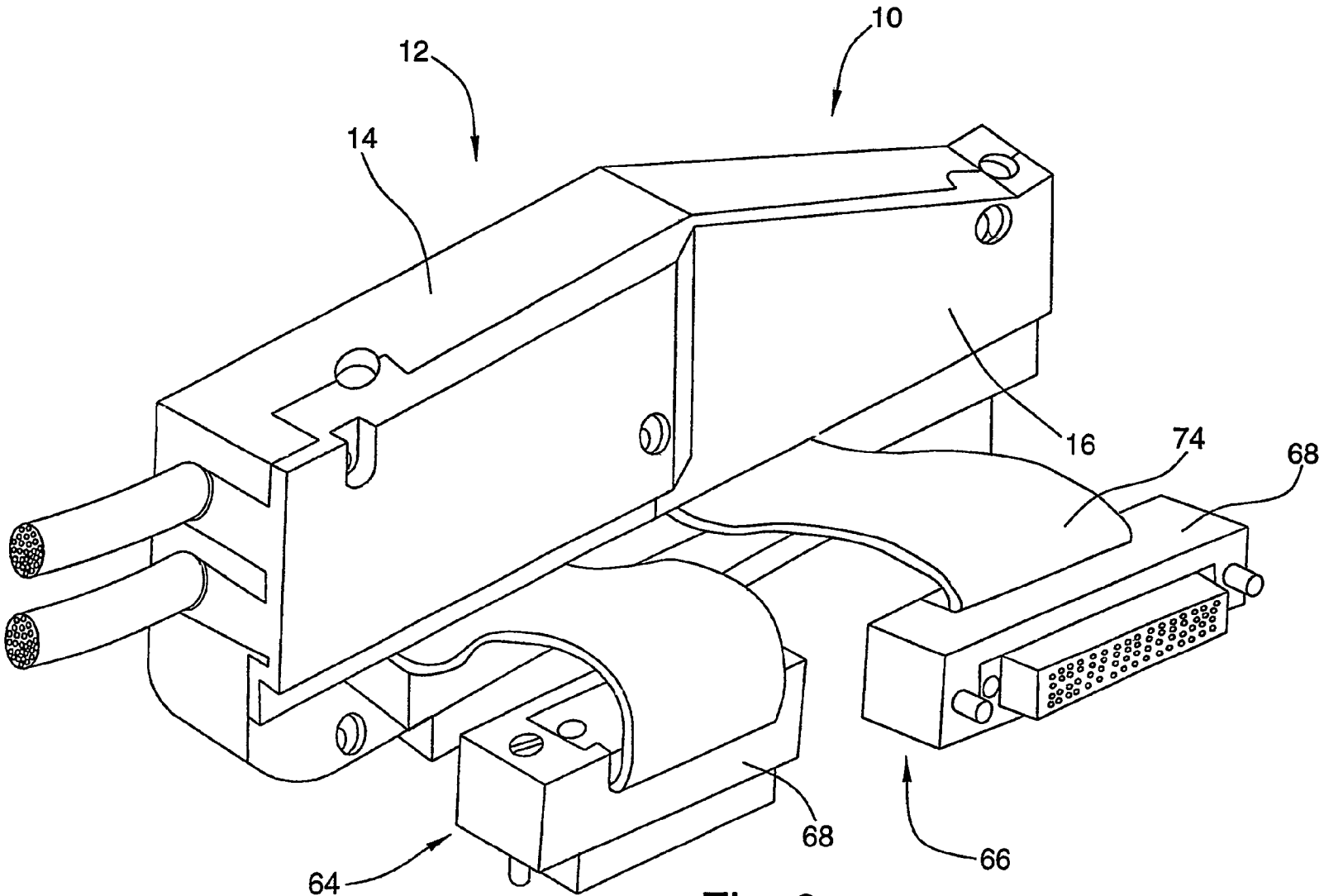
FIG. 6 is an isometric view of an alternative of the connector of FIG. 1 provided with additional connector elements arranged outside the connector.
Figure 7:
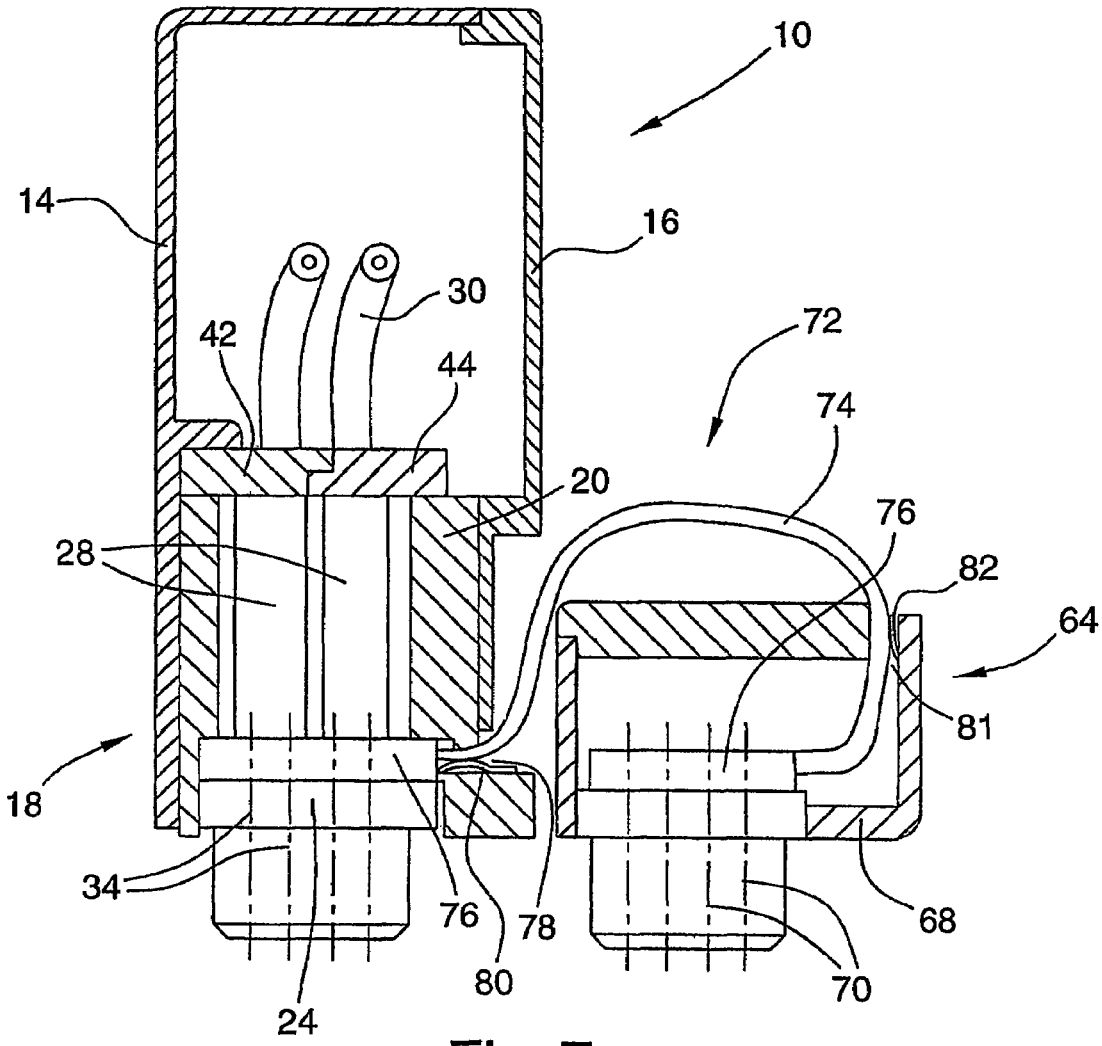
FIG. 7 is a cross-sectional view of the embodiment of the connector according to FIG. 6.
Figure 8:
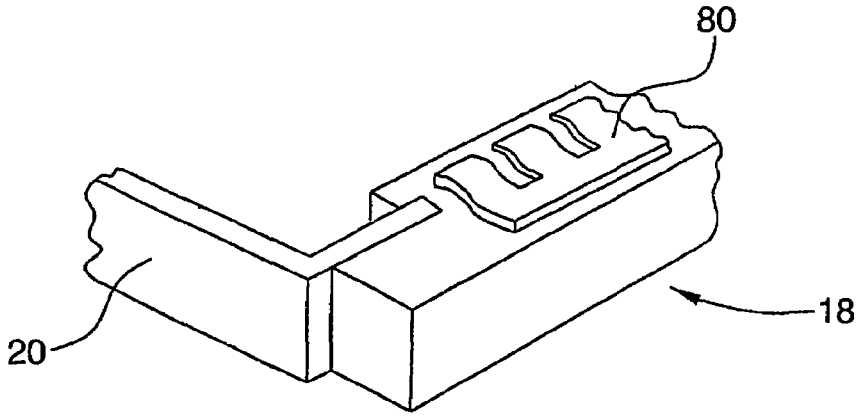
FIG. 8 is a view onto a part of the connector shown in FIG. 7.

In FIGS. 6 to 8 another embodiment of the invention is shown. This embodiment also includes a multiple wire cable connector 10 like that as described in connection with FIGS. 1 to 3 and, in addition, two additional connectors 64,66 connected to the contact pins 34 of the inner housings 18 (see FIG. 2). The design and construction of the additional connectors 64 is not critical as long as they provide electromagnetic shielding. In the specific embodiment described hereinbelow, each of the additional connectors 64 is provided with a housing 68 with contact elements 70 extending out of the housing 68 and connected via electromagnetically shielded conducting lines 72 to the contact pins 34 of the associated inner housing 18 of the connector 10. The housings 68 of the additional connectors 64, for example, could be made from metal although other materials providing electromagnetic shielding can also be used (for example conductive coatings on non-conductive supporting materials).

The conducting lines 72 are provided as a flexible circuit 74 with printed circuit boards 76 (PCB) at the connecting ends of the flexible circuit 74. The PCB 76 are press-fit connected to the contact pins 34 of the inner housings 18 and are connected to the contact elements 70 of the additional connectors 64. Also this connection can be provided by a press-fit. It is clear that other electrical connections between the PCB 76 and the contact elements of the inner housings 18 and the additional connectors 64 are possible, i.e. soldering.

The flexible circuit 74 extends through a slit-like opening 78 of each of the inner housings 18 (see FIG. 7). Within this slit-like opening 78 an electromagnetic shielding gasket 80 (see FIGS. 7 and 8) is arranged. This particular electromagnetic shielding gasket is similar to a type known in the art. An electromagnetic shielding gasket is also arranged in a slit-like opening 81 of the housing 68 of each of the additional connectors 64. This electromagnetic shielding gasket 82 is shown in FIG. 7.

It should be clear to those skilled in the art that other types of conducting lines 74 can be used. As an example the connection of the contact elements 70 and 34 of the additional connectors 64 and the inner housings 18 of the connector 10 can also be established by an electromagnetically shielded ribbon cable or by individual cables.

Figure 9:
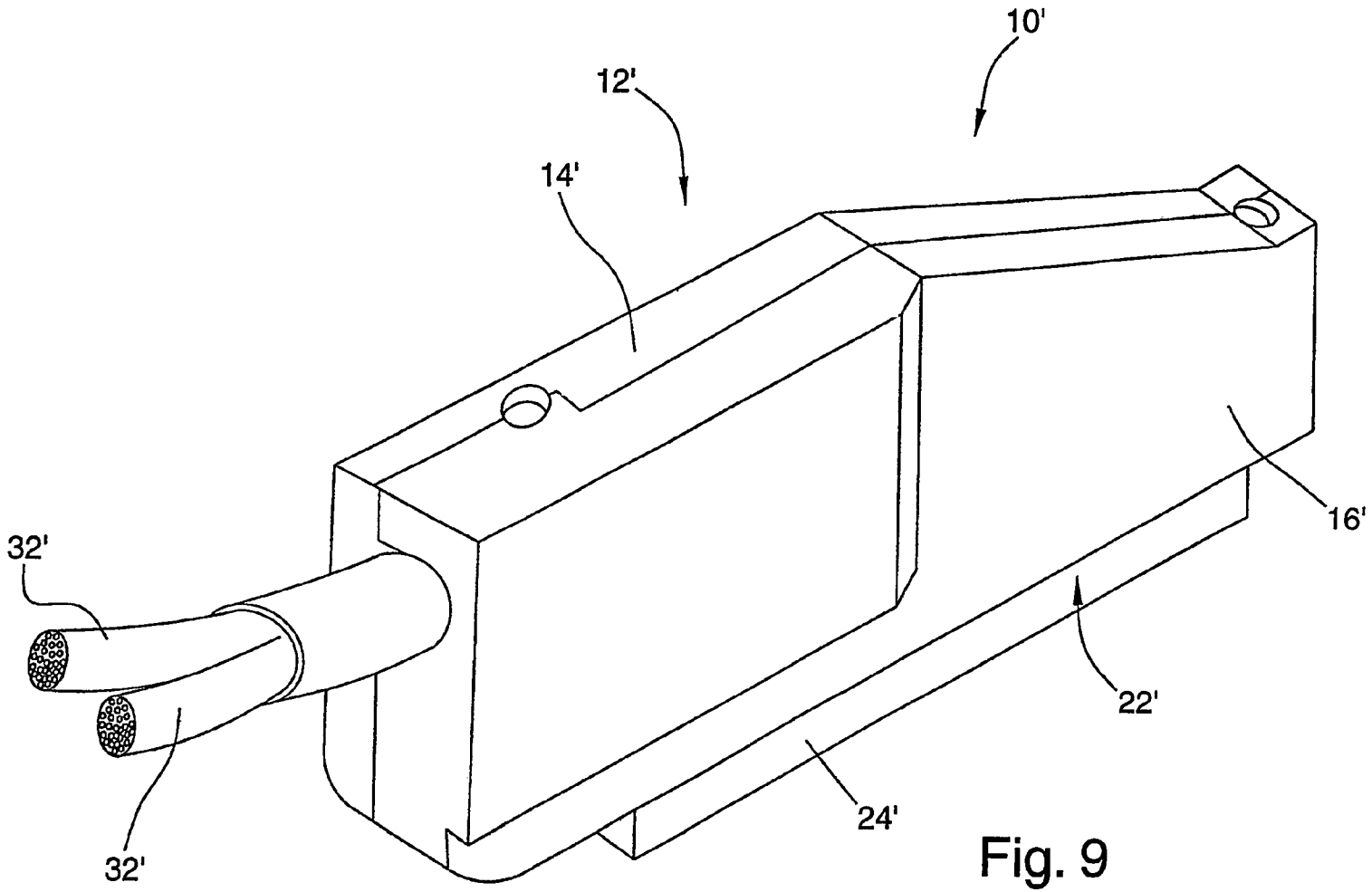
FIG. 9 is an isometric view of a connector according to another embodiment of the invention.
Figure 10:
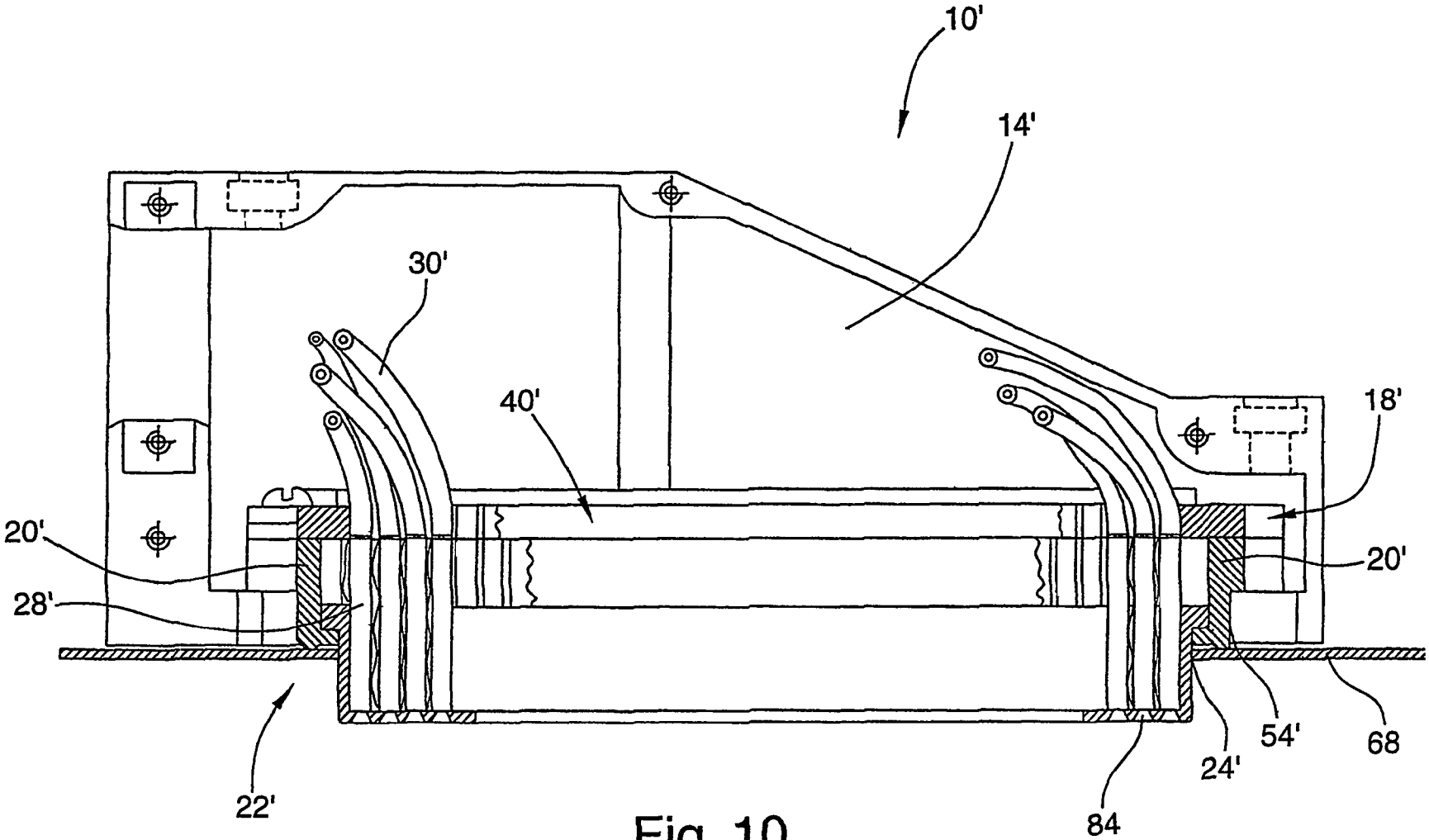
FIG. 10 is a cross-sectional view of the connector of FIG. 9 and, FIG. 11 is another cross-sectional view of the connector of FIG. 9.
Figure 11:
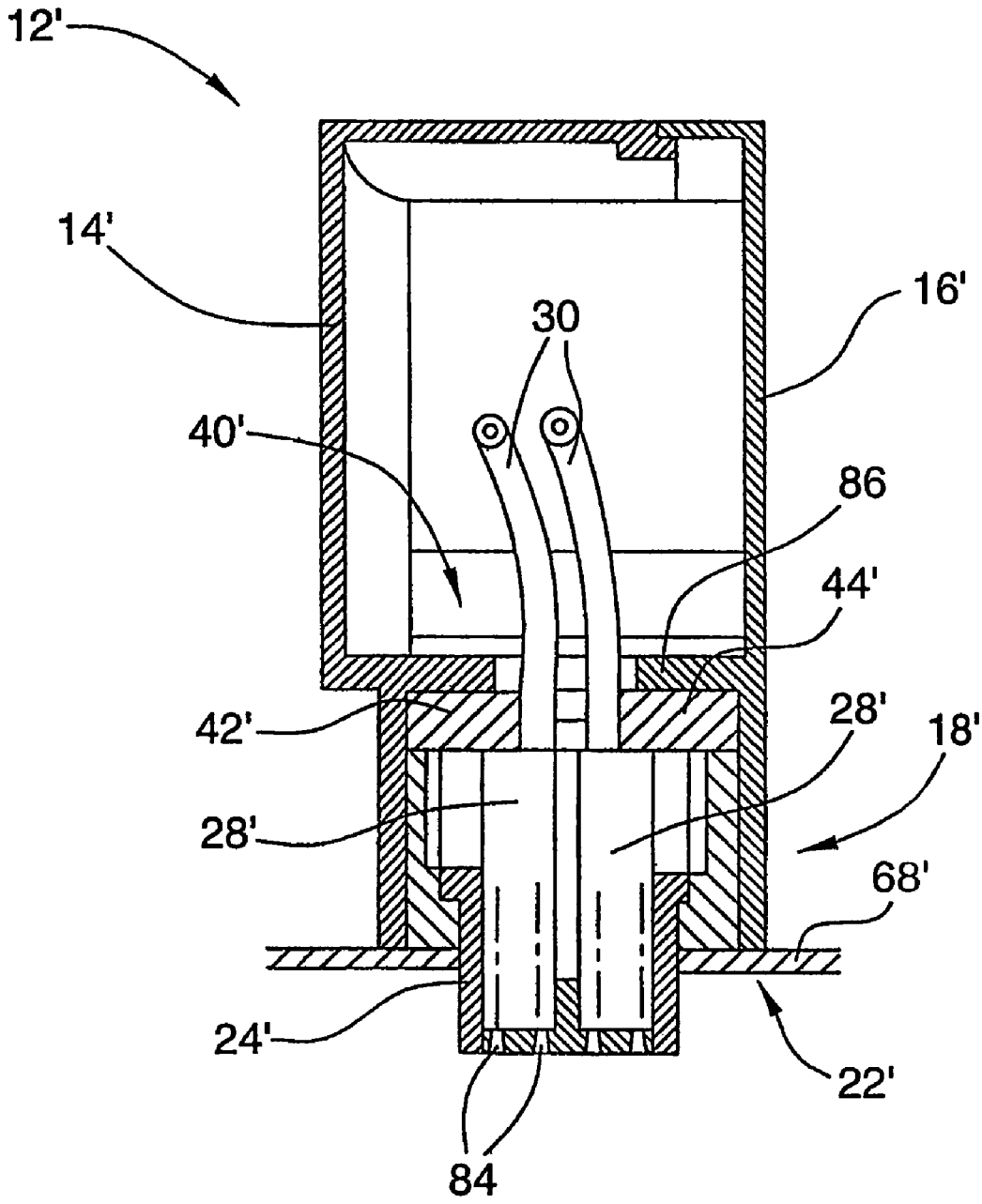

In FIGS. 9 to 11 a third embodiment of a multiple wire cable connector 10' is shown. As far as the individual parts of the connector 10' are identical or similar from their function or construction to the individual parts of the connector 10 according to the other embodiments, in FIGS. 9 to 11 the same reference numerals provided with a prime are used.

The construction of the connector 10' is similar to that of the connector 10 of FIGS. 1 to 3. One difference between both connectors relates to the fact that the connector 10' merely comprises one inner housing 18'. A receiving element 24' for receiving a multitude of termination sockets 28' projects from the front end 22' of the inner housing 18'. This receiving element 24' is different from a board mount socket since it does not comprise contact pins to be contacted by the cable termination sockets 28'. In the receiving element 24' there are a lot of bores 84 aligned with the contact elements (not shown) of the cable termination sockets 28'. The receiving element 24' of the inner housing 18' is placed over contact pins (not shown) of an electronic device to be connected by the connector 10' wherein the contact pins of the electronic device directly contacts the contact elements of the cable termination sockets 28'.

As can be seen from FIG. 11, the cover sections 42',44' of the cover 40' are held down against the inner housing 18' by means of protruding web-like elements 86 located and integrally connected to the casing segments 12',14' of the outer housing 12'. This is an alternative mounting arrangement of the cover 40' over the connector 10 of FIGS. 1 to 3 in which the cover 40 is mounted by suitable fastening means like screws or bolts or the like.

Moreover, in the embodiment according to FIGS. 9 to 11 the inner housing 18' is not biased or floatingly arranged within the receiving opening 54' of the outer housing 12'. The front end 22 of the inner housing 18' directly contacts the face plate 68' (see FIGS. 10 and 11) to help prevent electromagnetic leakage of the connection. An electromagnetic shielding gasket such as that discusses earlier (not shown) can be arranged between the front end 22' and the face plate 68'. For example, an electromagnetic shielding gasket similar to the electromagnetic shielding gasket shown in FIG. 8 can be used. Alternatively an electromagnetic shielding gasket in the shape of a corrugated ring-like element could also be used.

Although not shown in the embodiment of FIGS. 9 to 11, the connector 10' can also be provided with several inner housings 18' floatingly arranged as shown in FIGS. 1 to 3 and described in the accompanying text. Also it is possible that the additional connectors as disclosed in connection with the embodiment of FIGS. 6 to 8 can be added to the connector 10' of FIGS. 9 to 11.

As will be apparent to those skilled in the art, in the light of the foregoing disclosure many alternations and modifications are possible in the practice of this invention without departing from the spirit or scope thereof. Accordingly, the scope of invention is to be construed in accordance with the substance defined by the following claims.

What is claimed is:

1. Multiple wire cable connector comprising an outer housing having at least one opening for a multiple wire cable to pass therethrough, at least one inner housing for arranging therein termination sockets for the wires of the multiple wire cable, the inner housing comprising (i) a front end for contacting a device to be electrically connected to the wires of the multiple wire cable, and (ii) a receiving end for receiving the wires of the multiple wire cable, wherein the inner housing comprises a circumferential wall extending between the front and receiving ends of the inner housing, and at least one cover for covering the receiving end of the inner housing(s), wherein the cover and the circumferential wall of the inner housing both comprise electrically conductive material, and wherein the outer housing comprises at least one receiving opening in which the at least one of the inner housing is arranged.

2. Multiple wire cable connector according to claim 1, wherein the inner housings are movably arranged within the receiving opening (54) of the outer housing.

3. Multiple wire cable connector according to claim 2, wherein the inner housings are located within the receiving opening of the outer housing with a play for allowing tilting movements of the inner housings within the receiving openings.

4. Multiple wire cable connector according to claim 2, wherein the inner housing is pivotable around a pivot axis parallel to the plane of the receiving opening.

5. Multiple wire cable connector according to claim 2, wherein the inner housing is pivotable with respect to pivot axis orthogonal to each other and parallel to the plane of the receiving opening.

6. Multiple wire cable connector according to any one of claims 1 to 5, wherein at least one resilient means is arranged between the at least one of the inner housings and outer housing to bias the respective inner housing in a direction out of the receiving opening of the outer housing.

7. Multiple wire cable connector according to claim 6, wherein the resilient means is a helical spring element, a beam-like spring element or an element comprising compressible material.

8. Multiple wire cable connector according to claim 6, wherein the resilient means on the one hand is operatively connected to the outer housing and on the other hand is operatively connected to the respective inner housing.

9. Multiple wire cable connector according to claim 1, wherein at least one electromagnetic shielding gasket is provided for each inner housing.

10. Multiple wire cable connector according to claim 1, wherein the outer housing (12) comprises an electrically conductive material.

11. Multiple wire cable connector according to claim 9, wherein the cover is in direct contact with the circumferential wall of the inner housing.

12. Multiple wire cable connector according to claim 1, wherein the cover is provided with openings for the wires of the multiple wire cable.

13. Multiple wire cable connector according to claim 12, wherein the cover comprise at least two engaging cover sections each having an edge with recesses therein such that when the at least two cover sections are engaged together, the recesses form the openings in the cover.

14. Multiple wire cable connector according to claim 13, wherein the edges of the at least two cover sections overlap when engaged with each other.

15. Multiple wire cable connector according to claim 1, wherein each inner housing comprises contact elements for connection to the wires of the multiple wire cable.

16. Multiple wire cable connector according to claim 10, wherein the contact elements of at least one inner housing by conducting lines are electrically connected to at least one additional connector element located outside of the outer housing.

17. Multiple wire cable connector according to claim 16, wherein the conducting lines are in the form of a flexible circuit or a ribbon cable.

18. Multiple wire cable connector according to claim 16, wherein each conducting line extends through at least one opening in the wall of the inner housing and wherein the opening is provided with an electromagnetic shielding gasket.

19. Multiple wire cable connector according to claim 1, wherein the outer housing is provided with at least two inner housings.

* * * * *